US007472629B2

(12) United States Patent
Davidson

(10) Patent No.: US 7,472,629 B2
(45) Date of Patent: Jan. 6, 2009

(54) RATCHET WRENCH

(75) Inventor: John B. Davidson, Chicago, IL (US)

(73) Assignee: JODA Enterprises, Inc., Chicago, IL (US)

( * ) Notice: Subject to any disclaimer, the term of this patent is extended or adjusted under 35 U.S.C. 154(b) by 0 days.

(21) Appl. No.: 10/580,775

(22) PCT Filed: Feb. 17, 2004

(86) PCT No.: PCT/US2004/004616

§ 371 (c)(1),
(2), (4) Date: May 26, 2006

(87) PCT Pub. No.: WO2005/061185

PCT Pub. Date: Jul. 7, 2005

(65) Prior Publication Data

US 2007/0000355 A1 Jan. 4, 2007

Related U.S. Application Data

(60) Provisional application No. 60/523,034, filed on Nov. 18, 2003.

(51) Int. Cl.
*B25B 13/46* (2006.01)

(52) U.S. Cl. ..... 81/60; 81/58.1

(58) Field of Classification Search ..... 81/58.1, 81/58.4, 60–62, 63.1, 63.2, 59.1
See application file for complete search history.

(56) References Cited

U.S. PATENT DOCUMENTS 460,474 A * 9/1891 Knapp et al. ..... 81/63
2,708,855 A * 5/1955 Fish ..... 81/61
3,508,455 A * 4/1970 Miller ..... 81/58.1
3,575,069 A 4/1971 White
3,823,625 A 7/1974 Myers
3,824,881 A 7/1974 Wright
4,054,067 A 10/1977 Blank
4,212,336 A 7/1980 Smith
5,152,196 A * 10/1992 Garrett ..... 81/58.1
5,568,757 A * 10/1996 Lewis ..... 81/177.2

(Continued)

FOREIGN PATENT DOCUMENTS

GB 2248572 A * 4/1992

OTHER PUBLICATIONS

International Search Report from PCT Application No. PCT/US2004/004616.

*Primary Examiner*—David B Thomas
(74) *Attorney, Agent, or Firm*—Brinks Hofer Gilson & Lione; Gregory H. Zayia

(57) ABSTRACT

A ratchet wrench has a drive-stud element with a drive stud at a first end and a drive recess at a second end. The drive-stud element is coupled with a one-way drive transmitting wheel to rotate in unison therewith about an axis. The wrench can have a centering element that resists movement of the one-way drive transmitting wheel in at least one direction away from the axis. The drive-stud element and the one-way drive transmitting wheel can be separately formed. A method is also disclosed for operating a ratchet wrench with a drive-stud element with a drive stud at a first end and a drive recess at a second end.

30 Claims, 3 Drawing Sheets

U.S. PATENT DOCUMENTS

| | | | | |
|---|---|---|---|---|
| 5,596,913 | A | 1/1997 | Matsubara et al. | |
| 6,182,536 | B1 | 2/2001 | Roberts et al. | |
| 6,482,536 | B1 | 11/2002 | Tanaka et al. | |
| 7,082,860 | B2 * | 8/2006 | Shu-Sui et al. | 81/63.1 |
| 2003/0121371 | A1 | 7/2003 | Chiu | |
| 2003/0131692 | A1 | 7/2003 | Huang | |

* cited by examiner

RATCHET WRENCH

RELATED APPLICATIONS

This application is the National Stage of International Application No. PCT/US2004/004616, filed Feb. 17, 2004, which claims the benefit of U.S. Provisional Application No. 60/523,034, filed Nov. 18, 2003.

BACKGROUND

Ratchet wrenches that contain a drive stud shaped and dimensioned to be received by an opening in a tool such as a socket are well known in the art. In addition to having a drive stud, the ratchet wrench disclosed in U.S. Pat. No. 3,575,069 to White contains an exposed drive recess in its ratchet wheel. The drive recess can be connected to a drive stud of a non-ratcheting tool with a screwdriver-type handle, which is used to turn a nut, screw, or bolt when it becomes difficult or impractical to use the primary handle of the wrench for a ratcheting operation. U.S. Pat. No. 6,182,536 to Roberts et al. discloses another tool that has a drive stud and an exposed drive recess.

Other ratchet wrenches have components that resist movement of the ratchet wheel away from the axis of rotation. For example, in the wrench disclosed in U.S. Pat. No. 4,420,995 to Roberts, a ratchet wheel is provided with an annular raised boss on the side of the ratchet wheel opposite the drive stud, and this boss fits within a recess in the head of the wrench. The boss resists forces tending to decenter the ratchet wheel with respect to its axis of rotation. Additionally, U.S. Pat. No. 6,109,140 to Roberts et al. discloses a centering element that extends from the head of a wrench into an annular recess on a face of a ratchet wheel opposed to a drive stud.

SUMMARY

The present invention is defined by the following claims, and nothing in this section should be taken as a limitation on those claims.

By way of introduction, the preferred embodiments described herein relate to ratchet wrenches that comprise a drive-stud element comprising a drive stud at a first end and a drive recess at a second end. The drive-stud element is coupled with a one-way drive transmitting wheel to rotate in unison therewith about an axis. In one preferred embodiment, the one-way drive transmitting wheel/drive-stud element combination comprises a first face opposite the drive stud. The first face comprises a load-bearing surface that extends at least partly around the axis, and the one-way drive transmitting wheel extends farther than the load-bearing surface from the axis. The head comprises a non-rotating centering element that engages the load-bearing surface and is positioned to resist movement of the one-way drive transmitting wheel in at least one direction away from the axis.

In another preferred embodiment, the drive-stud element and the one-way drive transmitting wheel are separately formed. In yet another preferred embodiment, a method is disclosed for operating a ratchet wrench with a drive-stud element comprising a drive stud at a first end and a drive recess at a second end. A tool is coupled to the drive stud of the ratchet wrench, and a drive stud of a second ratchet wrench is coupled with the drive recess of the first ratchet wrench. The first ratchet wrench is rotated to rotate the tool in a first direction while the second ratchet wrench is counter-rotated in a second direction, opposite the first direction. Then, the second ratchet wrench is rotated to rotate the tool in the first direction while the first ratchet wrench is counter-rotated in the second direction. Other preferred embodiments are provided, and each of the preferred embodiments described herein can be used alone or in combination with one another.

The preferred embodiments will now be described with reference to the attached drawings.

DETAILED DESCRIPTION OF THE PRESENTLY PREFERRED EMBODIMENTS

Figure 1:
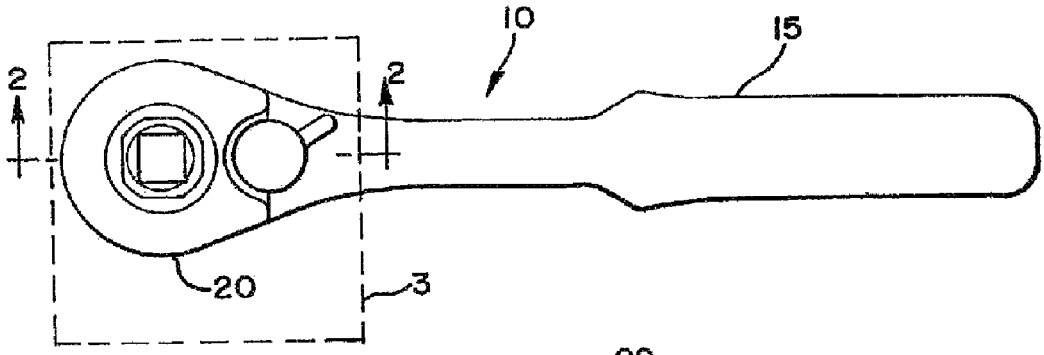
FIG. 1 is a plan view of a ratchet wrench of a preferred embodiment.
Figure 2:
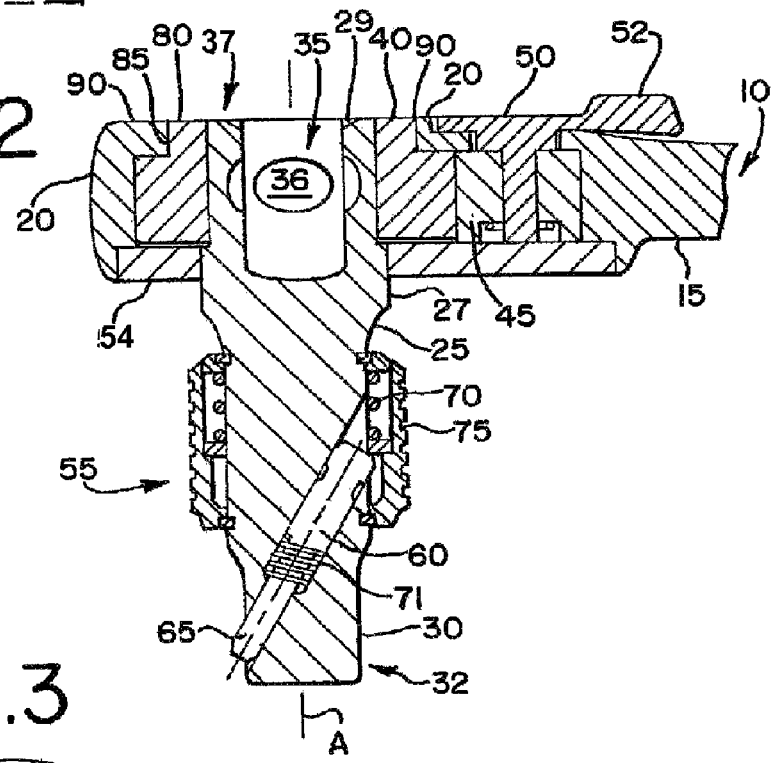
FIG. 2 is a cross-sectional view taken along line 2-2 of FIG. 1.
Figure 3:
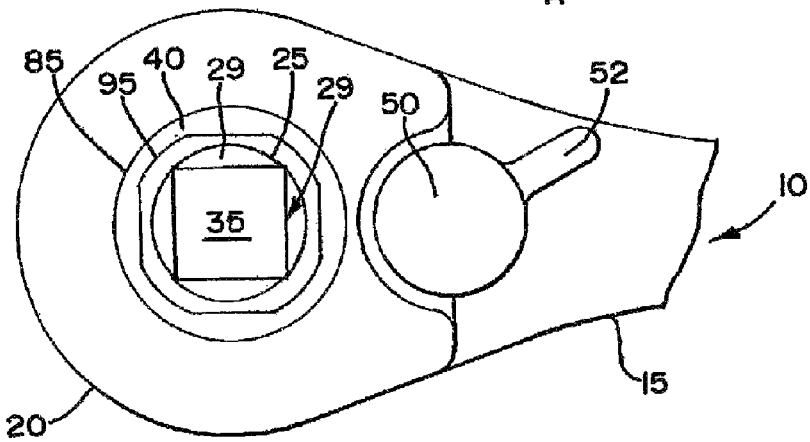
FIG. 3 is an expanded view of part of the ratchet wrench of FIG. 1.

Turning now to the drawings, FIG. 1 is a plan view of a ratchet wrench 10 of a preferred embodiment, FIG. 2 is a cross-sectional view taken along line 2-2 of FIG. 1, and FIG. 3 is an expanded plan view of part of the ratchet wrench 10 shown in FIG. 1. As shown in these figures, the ratchet wrench 10 comprises a handle 15 that comprises a head 20. As shown in FIG. 2, the ratchet wrench 10 supports a drive-stud element 25 for rotation. The drive-stud element 25 has a drive stud 30 at a first end 32 and a drive recess 35 at a second end 37. The drive stud 30 is shaped and dimensioned to be received by an out-of-round opening in a tool. As used herein, the term "tool" broadly refers to any type of torque-transmitting tool, including, but not limited to, sockets, hex keys, screwdriver blades, and the like. It should be noted that the drive stud 30 can take additional shapes and is not required to be square in all embodiments. Other out-of-round shapes suitable for transmitting torque by mating with a female cavity in a driven element may be used, including hexagonal shapes, for example.

The drive recess 35 is shaped and dimensioned to receive a drive stud of an axially-aligned driving tool. In this illustrated embodiment, the drive recess 35 has four recesses 36 that accept a detent ball or a pin of a quick-release mechanism of an axially-aligned driving tool. In another embodiment, a hole is used instead of a recess. As used herein, a "driving tool" broadly refers to any torque transmitting device, including, but not limited to, another wrench, an extension bar, and a nut driver. Additionally, as shown in FIGS. 2 and 3, the second end 37 has a beveled entrance 29 to provide self-centering for a drive stud being coupled to the drive recess 35.

Although the drive recess 35 is shown as flush with the top surface of the head 20, the drive stud element 25 can be positioned so that the drive recess 35 is above or below the top surface of the head 20. Further, the drive-stud element 25 can be of any desired length, and, in this embodiment, takes the form of an extension bar. The drive-stud element 25 can take other forms, such as a universal joint, for example.

The ratchet wrench 10 also comprises a one-way drive transmitting wheel 40 and a ratchet mechanism 45 coupled between the one-way drive transmitting wheel 40 and the handle 15. As used herein, the term "one-way drive transmitting wheel" refers to a wheel that provides ratcheting action when used with the appropriate ratchet mechanism and can be toothed (e.g., a ratchet wheel) or non-toothed (e.g., a disc with a friction surface around its circumference or a clutch mechanism). The ratchet mechanism 45 controls rotation of the drive-stud element 25 with respect to the handle 15. The one-way drive transmitting wheel 40 is coupled to the drive-stud element 25, and they are rotatably mounted in the head 20 to rotate in unison about an axis A. In this embodiment, the one-way drive transmitting wheel 40 takes the form of a toothed ratchet wheel, and the ratchet mechanism 45 takes the form of a pawl that engages the teeth of the toothed ratchet wheel. Although shown as being positioned at the top of the drive-stud element 25, the one-way drive transmitting wheel 40 can be positioned at any intermediate point along the length of the drive-stud element 25. Additionally, a quick-release mechanism can be used to allow the drive-stud element 25 to be easily removed from the head 20 of the wrench 10. A cover plate 54 coupled with the head 20 and handle 15 hold the components mentioned above in the head 20.

The ratchet wrench 10 further comprises a reversing lever 50 that can be used to control the ratchet mechanism 45 of the wrench 10. The reversing lever 50 includes a handle 52. In this embodiment, the reversing lever 50 moves the ratchet mechanism 45 into any one of three functional positions: forward, neutral, and reverse. A detent ball (not shown) backed by a spring (not shown) resiliently holds the ratchet mechanism 45 in any one of these three positions. In the neutral position, the ratchet mechanism 45 is held out of contact with the one-way drive transmitting wheel 40, preventing ratcheting action and, if desired, allowing free-wheeling motion of the one-way drive transmitting wheel 40 and the drive-stud element 25 with respect to the handle 15. In the forward and reverse positions, the ratchet mechanism 45 allows only one-direction rotation of the one-way drive transmitting wheel 40 in the forward and reverse directions, respectively. It is not required in all embodiments that the pawl be held in the neutral position by a detent mechanism. The neutral position may be maintained in other ways and by other means, including frictional holding means, for example. Alternately, the ratchet mechanism 45 may be shaped to be in stable equilibrium when in the neutral position. Also, it is not necessary to have a neutral position. For additional information, see U.S. Pat. No. 6,109,140, which is assigned to the assignee of the present invention and is hereby incorporated by reference.

In this embodiment, the drive-stud element 25 carries a quick-release mechanism 55. As shown in FIG. 2, the drive-stud element 25 defines a diagonally-oriented opening, and a locking pin 60 is positioned within the opening to move in the opening. In its engaging position, a first end 65 of the locking pin 60 engages a recess in a tool to lock the tool positively in place on the drive stud 30. A spring 70 biases the locking pin 60 downwardly. To release the tool from the drive stud 30, the operator moves a collar 75 that is coupled to the spring 70 upwardly. When the collar 75 is pulled up, the spring 70 is compressed, and the spring 71 surrounding the locking pin 60 causes the locking pin 60 to retract and move upwardly in the opening, resulting in the first end 65 of the locking pin 60 moving out of contact with the tool. The tool is thereby released from the drive stud 30. Further details of the quick-release mechanism 55 can be found in U.S. Pat. No. 5,644,958, which is assigned to the assignee of the present application and is hereby incorporated by reference. It is important to note that other tool-release mechanisms can be used. For example, instead of using the illustrated quick release mechanism, a spring-loaded detent ball on the drive stud 30 can be used. With this structure, the ball is allowed to move entirely inside the drive-stud element 25 to allow a tool to be inserted on and removed from the drive stud 30. When the tool is inserted on the drive stud 30, the ball can protrude partly out of the drive stud 30 into a recess in the tool to positively retain the tool on the drive stud 30. Another suitable arrangement is shown in U.S. Pat. No. 6,109,140, which is assigned to the assignee of the present invention and is hereby incorporated by reference. It is also important to note that the use of a quick-release mechanism is not necessary in these embodiments.

Returning again to FIG. 2, the combination of the one-way drive transmitting wheel 40 and the drive-stud element 25, which is referred to herein at the "wheel/drive-stud element combination," comprises a first face 80 opposite the drive stud 30. The first face 80 comprises a load-bearing surface 85 extending at least partly around the axis A. As shown in FIG. 2, the one-way drive transmitting wheel 40 extends farther than the load-bearing surface 85 from the axis A. In this embodiment, the head 20 of the wrench 10 comprises a non-rotating centering element 90 that engages the load-bearing surface 85. The centering element 90 is shaped to expose the drive recess 35 for connection to an axially-aligned driving tool. The centering element 90 engages the one-way drive transmitting wheel 40 to center the one-way drive transmitting wheel 40 against torques and other applied loads tending to decenter the one-way drive transmitting wheel 40 with respect to the axis A. In general, the centering element 90 is shaped to center the one-way drive transmitting wheel 40 against yawing movement away from the ratchet mechanism 45 that would interfere with effective engagement between the one-way drive transmitting wheel 40 and the ratchet mechanism 45. Additionally, if desired, the centering element 90 can be shaped to center the one-way drive transmitting wheel 40 in other directions, such as movement toward the ratchet mechanism 45 and/or movement at right angles to a line extending between the axis A and the ratchet mechanism 45.

The centering element 90 can be shaped in any suitable manner to resist movement of the one-way drive transmitting wheel 40 in at least one direction away from the axis A. For example, the centering element 90 can extends continuously around the axis A or can extend around the axis A over more than 180° but less than 360°. Other shapes are possible, such as a horseshoe shape. Additionally, the centering element 90 can contain gaps or notches.

Figure 4:
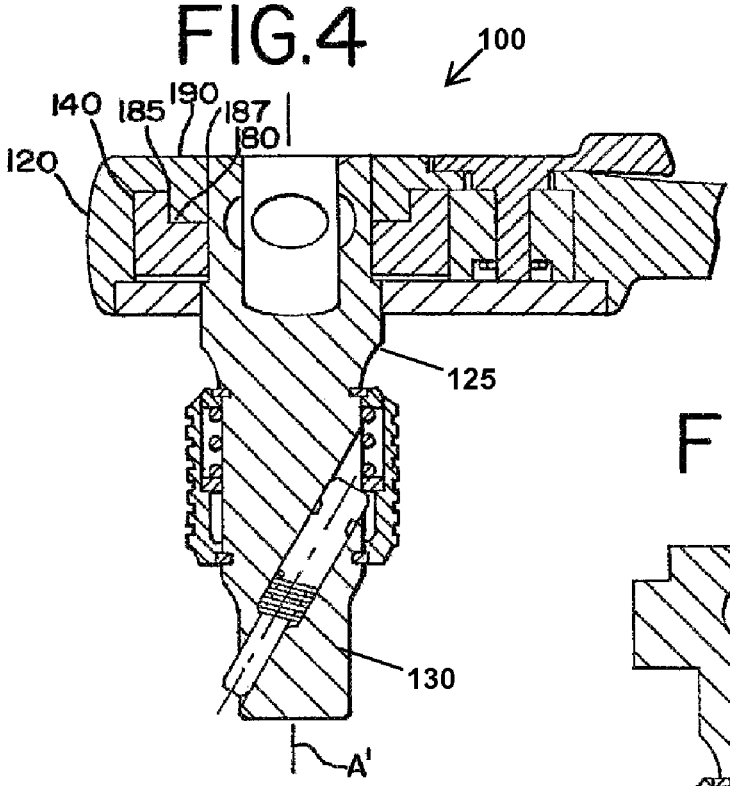
FIG. 4 is a cross-sectional view of another preferred embodiment.

While the load-bearing surface 85 was formed entirely on the one-way drive transmitting wheel 40 in this embodiment, in other embodiments, the load-bearing surface is formed entirely on the drive-stud element or in part on the one-way drive transmitting wheel and in part on the drive-stud element. Further, the load-bearing surface can face radially outwardly (as shown in FIG. 2) or radially inwardly with respect to the axis. Additionally, part of the load-bearing surface can face radially inwardly with respect to the axis while another part of the load-bearing surface faces radially outwardly with respect to the axis. This alternative is illustrated in FIG. 4. As shown in FIG. 4, the wheel/drive-stud element combination includes a face 180 opposite the drive stud 130. The face 180 comprises a load-bearing surface, part of which 185 is formed as part of the outer edge of the one-way drive transmitting wheel 140 and another part of which 187 is formed as part of the outer diameter of the drive-stud element 125. The head 120 of the wrench 100 defines a non-rotating centering element 190 that, in this embodiment, is a raised annulus received in a mating recess in the one-way drive transmitting wheel 140. The non-rotating centering element 190 engages the load-bearing surfaces 185, 187 and is positioned to resist movement of the one-way drive transmitting wheel 140 in at least one direction away from the axis A'. Of course, the other features and aspects of the embodiment shown in FIG. 2 can be used with the embodiment shown in FIG. 4.

Figure 5:
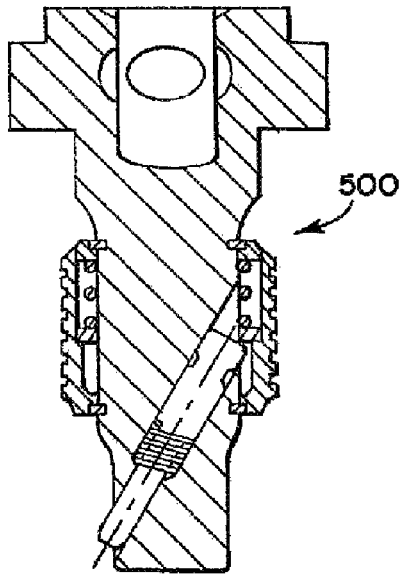
FIG. 5 is a cross-sectional view of a wheel/drive-stud element combination of a preferred embodiment formed as a single component.

As described above, the one-way drive transmitting wheel 40 is coupled (or connected) to the drive-stud element 25. As used herein, the term "coupled" (or "connected") is intended broadly to encompass both direct and indirect coupling (or connecting). Thus, first and second parts are said to be coupled together when they are directly functionally engaged (e.g., by direct contact), as well as when the first part is functionally engaged with an intermediate part (e.g., a layer of adhesive or a key) which is functionally engaged either directly or via one or more additional intermediate parts with the second part. Also, two elements are said to be coupled when they are functionally engaged (directly or indirectly) at some times and not functionally engaged at other times. Further, "coupled" (or "connected") is broadly defined to encompass one-piece arrangements, unless the context requires otherwise. In this way, the one-way drive transmitting wheel 40 is coupled to the drive-stud element 25 irrespective of whether the one-way drive transmitting wheel 40 and drive-stud element 25 are separately formed elements that are later joined together or whether they are formed together as a single component. FIG. 5 shows a wheel/drive-stud element combination 500 formed as a single component.

In certain situations, it may be preferred to have the drive-stud element be separately formed from the one-way drive transmitting wheel rather than having the drive-stud element and one-way drive transmitting wheel be formed together as a single component. For example, if the drive-stud element and one-way drive transmitting wheel are formed as a single component, the presence of the one-way drive transmitting wheel can make it difficult to form a quick-release mechanism in the drive-stud element particularly if a short drive-stud element is desired. As another example, the use of two separate components allows existing drive-stud elements to be converted into wheel/drive-stud element combinations with minimal time and effort by simply adding a one-way drive transmitting wheel to the existing parts. Further, separately-formed components allow different sized one-way drive transmitting wheels to be made without making a new die for the drive-stud element.

Figure 6:
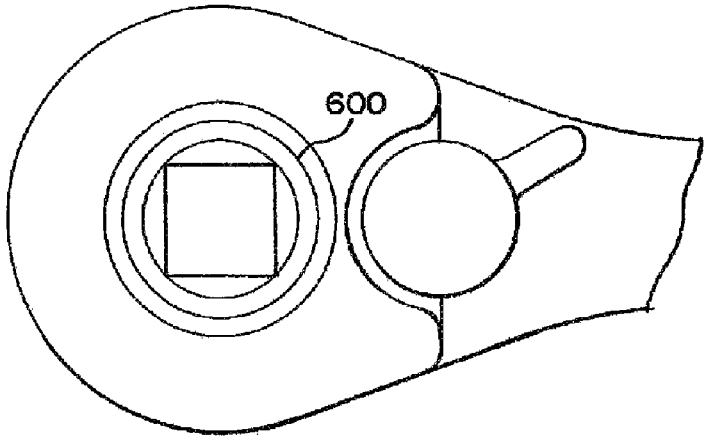
FIG. 6 is a view of a ratchet wrench of a preferred embodiment in which a contact region between a drive-stud element and a one-way drive transmitting wheel is generally circular.
Figure 7:
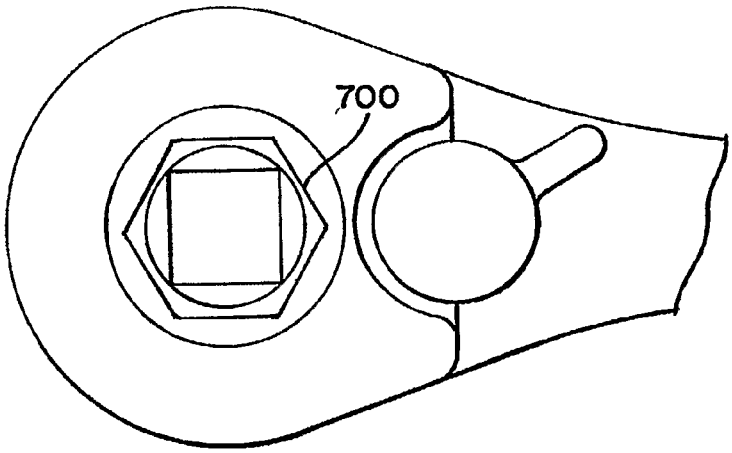
FIG. 7 is a view of a ratchet wrench of a preferred embodiment in which a contact region between a drive-stud element and a one-way drive transmitting wheel is generally hexagonal.
Figure 8:
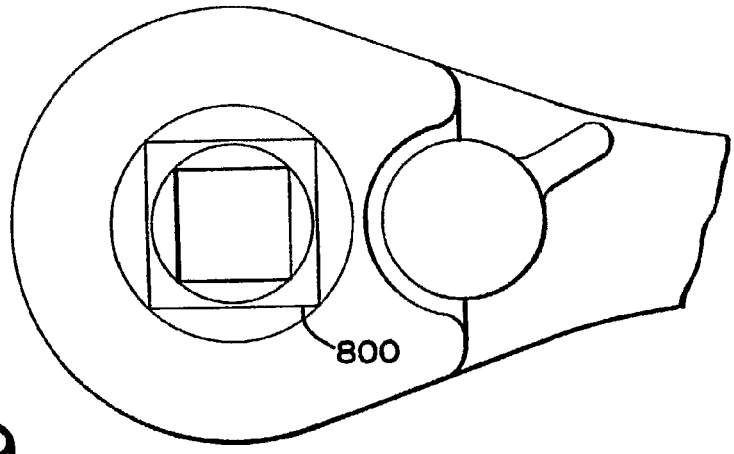
FIG. 8 is a view of a ratchet wrench of a preferred embodiment in which a contact region between a drive-stud element and a one-way drive transmitting wheel is generally square.
Figure 9:
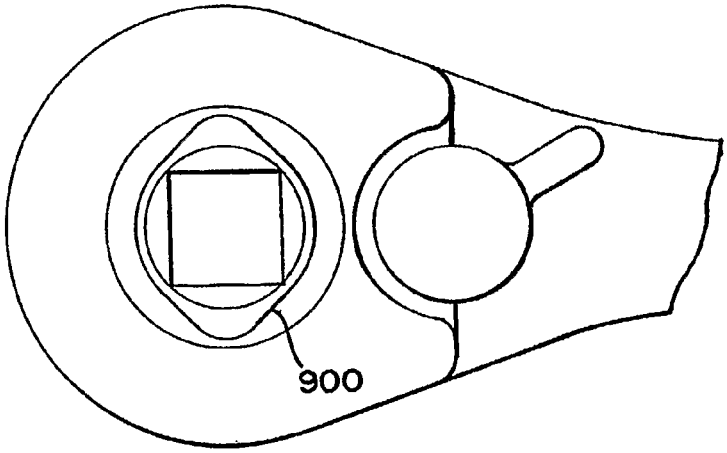
FIG. 9 is a view of a ratchet wrench of a preferred embodiment in which a contact region between a drive-stud element and a one-way drive transmitting wheel is generally ovoid.

When the drive-stud element and one-way drive transmitting wheel are separate components, they can differ from each other in at least one of composition, hardness, ductility, finish, malleability, and method of forming. This, for example, allows the drive-stud element to be made from a material that is suitable for cold forming operations (e.g., cold-headed), while allowing the one-way drive transmitting wheel to be made from a different material. In one presently preferred embodiment, the drive-stud element is made from a material at least as strong as 6140 chrome-vanadium steel, and the one-way drive transmitting wheel is made from US 4140 steel. The contact region between the drive-stud element and the one-way drive transmitting wheel can take any suitable shape including, but not limited to, shapes that are generally circular 600 (see FIG. 6), generally hexagonal 700 (see FIG. 7), generally square 800 (see FIG. 8), generally ovoid 900 (see FIG. 9), generally polygonal, and combinations thereof (e.g., half square, half hexagonal). In the embodiment shown in FIG. 3, the contact region 95 between the drive-stud element 25 and the one-way drive transmitting wheel 40 is generally circular with four planar portions that key the one-way drive transmitting wheel 40 to the drive-stud element 25 to ensure that the one-way drive transmitting wheel 40 and drive-stud element 25 rotate in unison.

The drive-stud element can be coupled to the one-way drive transmitting wheel by a press fit. As shown in FIG. 2, the drive-stud element 25 can be formed with a step 27 to assist in press-fitting the one-way drive transmitting wheel 40 to the correct position on the drive-stud element 25. Of course, other techniques can be used to connect the drive-stud element to the one-way drive transmitting wheel, including, but not limited to, solder, adhesive, and cross-bars. Further, the contact region can be non-round or splined. Additionally, while FIG. 2 shows the drive-stud element 25 press-fitted from the bottom of the one-way drive transmitting wheel 40, in an alternate embodiment, the drive-stud element is press-fitted from the top of the one-way drive transmitting wheel.

Finally, it is important to note that the separately-formed drive-stud element and one-way drive transmitting wheel can be used in a ratchet wrench with or without a centering element and/or quick-release mechanism.

Turning now to another preferred embodiment, a new method is provided where two ratchet wrenches are used to drive a tool. The first ratchet wrench comprises a handle, a one-way drive transmitting wheel mounted to the handle to rotate about an axis, a drive-stud element comprising a drive stud at a first end and a drive recess at a second end, and a ratchet mechanism coupled between the one-way drive transmitting wheel and the handle. The second ratchet wrench comprises a drive stud. It should be noted that either wrench can be of the types described above or of the type shown in U.S. Pat. No. 6,182,536, which is assigned to the assignee of the present invention and is hereby incorporated by reference. Further, either of the first and second ratchet wrenches can optionally have a centering element and/or quick-release mechanism. Additionally, the drive-stud element in the first ratchet wrench can be separately formed from the one-way drive transmitting wheel, or, alternatively, the drive-stud element and one-way drive transmitting wheel can be formed together as a single component.

In operation, the drive stud of a second ratchet wrench is coupled to the drive recess of the first ratchet wrench, and a tool is coupled to the drive stud of the first ratchet wrench. As noted above, a "tool" broadly refers to any type of torque-transmitting tool, including, but not limited to, sockets, hex keys, screwdriver blades, and the like. As also noted above, the "coupling" of the tool to the drive stud can be direct or indirect. In use, the first ratchet wrench is rotated to rotate the tool in a first direction while the second ratchet wrench is counter-rotated in a second direction, opposite the first direction. Then, the second ratchet wrench is rotated to rotate the tool in the first direction while the first ratchet wrench is counter-rotated in the second direction. When desired, the drive stud of the second ratchet wrench can be de-coupled from the drive recess of the first ratchet wrench. This provides for a two-handed/two-stroke drive operation that allows each wrench to be used in counterpoint.

While in the embodiments illustrated above, the one-way drive transmitting wheel took the form of a toothed ratchet wheel, and the ratchet mechanism took the form of a pawl, in other embodiments, the one-way drive transmitting wheel is non-toothed. For example, clutch-type ratchet mechanisms can be used. Unlike toothed ratchet wheels, clutch-type ratchet mechanisms allow for an extremely small angle to ratchet since the lack of teeth eliminate the requirement that the ratchet mechanism slip back at least one tooth to provide ratcheting action. U.S. Pat. Nos. 1,412,688 and 5,535,647, which are hereby incorporated by reference, disclose components that can be adapted to construct a clutch-type ratchet mechanism. As illustrated, the one-way drive transmitting wheel shown in FIGS. 2 and 4 can be either a toothed or non-toothed component.

Finally, each of these preferred embodiments can be used alone or in combination with one another. For example, the centering element embodiments can be used with a one-piece wheel/drive-stud element combination or with a wheel/drive-stud element combination that is made from separately-formed components. Further, the disclosed wrenches can be used alone or with a second wrench for a two-stroke operation. Additionally, as noted above, although a quick release mechanism is shown in the drawings, the use of a quick release mechanism is not required.

The foregoing detailed description has described only a few of the many forms that the present invention can take, and should therefore be taken as illustrative rather than limiting. It is only the following claims, including all equivalents, that are intended to define the scope of this invention.

What is claimed is:

1. A ratchet wrench comprising:

a handle comprising a head;

a drive-stud element comprising a drive stud at a first end and a drive recess at a second end;

a one-way drive transmitting wheel having a recess, the wheel being separately formed from and coupled to the drive-stud element to rotate in unison therewith, the one-way drive transmitting wheel and drive-stud element rotatably mounted in the head to rotate about an axis, wherein the one-way drive transmitting wheel coupled to the drive-stud element form a wheel/drive-stud element combination; and a ratchet mechanism coupled between the one-way drive transmitting wheel and the handle;

wherein the wheel/drive-stud element combination and the recess comprise a first face opposite the drive stud, the first face comprising a load-bearing surface extending at least partly around the axis, the one-way drive transmitting wheel extending farther than the load-bearing surface from the axis; and wherein the head comprises a non-rotating centering element engaging the load bearing surface and positioned to resist movement of the one-way drive transmitting wheel in at least one direction away from the axis, the centering element shaped to expose the drive recess for connection to an axially-aligned driving tool.

2. The invention of claim 1, wherein the centering element extends around the axis over more than 1800°.

3. The invention of claim 1, wherein the centering element extends continuously around the axis.

4. The invention of claim 1, wherein the centering element comprises a raised annulus.

5. The invention of claim 1, wherein at least part of the load-bearing surface faces radially outwardly with respect to the axis.

6. The invention of claim 1, wherein at least part of the load-bearing surface faces radially inwardly with respect to the axis.

7. The invention of claim 1, wherein the load-bearing surface is formed only on the one-way drive transmitting wheel.

8. The invention of claim 1, wherein the load-bearing surface is formed only on the drive-stud element.

9. The invention of claim 1, wherein part of the load-bearing surface is formed on the one-way drive transmitting wheel and another part of the load-bearing surface is formed on the drive-stud element.

10. The invention of claim 1, wherein the one-way drive transmitting wheel comprises a toothed ratchet wheel, and wherein the ratchet mechanism comprises a pawl that engages the toothed ratchet wheel.

11. The invention of claim 1, wherein the one-way drive transmitting wheel is non-toothed.

12. The invention of claim 1, wherein the drive-stud element and the one-way drive transmitting wheel are separately formed as respective parts that are secured together.

13. The invention of claim 12, wherein the drive-stud element and the one-way drive transmitting wheel differ in at least one of composition, hardness, ductility, finish, malleability, and method of forming.

14. The invention of claim 1, wherein the drive-stud element and the one-way drive transmitting wheel are formed together as a single component.

15. The invention of claim 1 further comprising a quick-release mechanism carried by the drive-stud element.

16. A ratchet wrench comprising:

a handle comprising a head;

a drive-stud element comprising a drive stud at a first end and a drive recess at a second end;

a one-way drive transmitting wheel having a recess, the wheel being separately formed from and connected to the drive-stud element to rotate in unison therewith, the one-way drive transmitting wheel and drive-stud element rotatably mounted in the head to rotate about an axis; and a ratchet mechanism coupled between the one-way drive transmitting wheel and the handle;

wherein the head comprises a non-rotating centering element engaging at least one of the drive-stud element and a portion of the recess of the one-way drive transmitting wheel.

17. The invention of claim 16, wherein the one-way drive transmitting wheel differs from the drive-stud element in at least one of composition, hardness, ductility, finish, malleability, and method of forming.

18. The invention of claim 16, wherein the centering element is positioned to resist movement of the one-way drive transmitting wheel in at least one direction away from the axis, and the centering element is shaped to expose the drive recess for connection to an axially aligned driving tool.

19. The invention of claim 16, wherein the one-way drive transmitting wheel comprises a toothed ratchet wheel.

20. The invention of claim 16, wherein the one-way drive transmitting wheel is non-toothed.

21. The invention of claim 16 further comprising a quick-release mechanism carried by the drive-stud element.

22. The invention of claim 16, wherein the drive-stud element contacts the one-way drive transmitting wheel in a contact region that is generally circular.

23. The invention of claim 16, wherein the drive-stud element contacts the one-way drive transmitting wheel in a contact region that is generally hexagonal.

24. The invention of claim 16, wherein the drive-stud element contacts the one-way drive transmitting wheel in a contact region that is generally square.

25. The invention of claim 16, wherein the drive-stud element contacts the one-way drive transmitting wheel in a contact region that is generally ovoid.

26. The invention of claim 16, wherein the drive-stud element contacts the one-way drive transmitting wheel in a contact region that is generally polygonal.

27. The invention of claim 16, wherein the drive-stud element contacts the one-way drive transmitting wheel in a contact region that is splined.

28. The invention of claim 16, wherein the drive-stud element contacts the one-way drive transmitting wheel in a contact region that is non-round.

29. A method for operating a ratchet wrench, the method comprising:

(a) providing a first ratchet wrench comprising:

a handle;

a one-way drive transmitting wheel having a recess and being mounted to the handle to rotate about an axis;

a drive-stud element comprising a drive stud at a first end and a drive recess at a second end, the drive-stud element coupled to rotate with the one-way drive transmitting wheel; and a ratchet mechanism coupled between the one-way drive transmitting wheel and the handle;

wherein the head comprises a non-rotating centering element engaging at least one of the drive-stud element and a portion of the recess of the one-way drive transmitting wheel:

(b) providing a second ratchet wrench comprising a drive-stud;

(c) coupling the drive stud of the second ratchet wrench and the drive recess of the first ratchet wrench;

(d) coupling the drive stud of the first ratchet wrench to a tool;

(e) rotating the first ratchet wrench to rotate the tool in a first direction while counter-rotating the second ratchet wrench in a second direction, opposite the first direction; and (f) rotating the second ratchet wrench to rotate the tool in the first direction while counter-rotating the first ratchet wrench in the second direction.

30. The method of claim 29 further comprising:

(g) de-coupling the drive stud of the second ratchet wrench and the drive recess of the first ratchet wrench.

* * * * *

UNITED STATES PATENT AND TRADEMARK OFFICE

CERTIFICATE OF CORRECTION

PATENT NO. : 7,472,629 B2
APPLICATION NO. : 10/580775
DATED : January 6, 2009
INVENTOR(S) : John B. Davidson It is certified that error appears in the above-identified patent and that said Letters Patent is hereby corrected as shown below:

In the Claims

Column 7, claim 2, line 57, after "axis over more than" replace "1800°" with --180°--.

Signed and Sealed this
Twelfth Day of April, 2011

David J. Kappos

David J. Kappos
*Director of the United States Patent and Trademark Office*